US008123550B2

(12) United States Patent
Hoshino et al.

(10) Patent No.: US 8,123,550 B2
(45) Date of Patent: Feb. 28, 2012

(54) CONNECTOR HAVING AN OPERATION LEVER AND ELASTIC NAILS

(75) Inventors: Hirokazu Hoshino, Tokorozawa (JP); Takayuki Kushida, Kawasaki (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/016,689

(22) Filed: Jan. 28, 2011

(65) Prior Publication Data

US 2011/0223790 A1 Sep. 15, 2011

(30) Foreign Application Priority Data

Mar. 12, 2010 (JP) ..... 2010-056222

(51) Int. Cl.
*H01R 12/24* (2006.01)

(52) U.S. Cl. ..... 439/495; 439/260

(58) Field of Classification Search ..... 439/329, 439/260, 495
See application file for complete search history.

(56) References Cited

U.S. PATENT DOCUMENTS 7,416,438 B2 * 8/2008 Hashiguchi et al. ..... 439/495
(Continued)

FOREIGN PATENT DOCUMENTS

JP 2008-277068 A 11/2008
(Continued)

OTHER PUBLICATIONS

Korean Search Report for Korean Application No. 10-2010-0039361 dated May 11, 2010 and English translation thereof, 11 pages.

(Continued)

*Primary Examiner* — Tho D Ta
(74) *Attorney, Agent, or Firm* — Osha • Liang LLP

(57) ABSTRACT

A connector has a base having an opening formed on a front surface side into which a distal end of a flexible print substrate is insertable, and a plurality of insertion holes arranged side by side at a predetermined pitch passing through from the front surface side to a rear surface side, connection terminals respectively including substantially T shape operation pieces respectively having movable contacts formed at first ends in a protruding manner to be pressure-welded to connection portions arranged side by side in the distal end of the flexible print substrate, the connection terminals being adapted to be inserted into the insertion holes, and an operation lever supported on the rear surface side of the base turnably on a turning support point on an upper surface side of the connection terminals.

16 Claims, 12 Drawing Sheets

U.S. PATENT DOCUMENTS

| | | | | |
|---|---|---|---|---|
| 7,422,472 | B2 * | 9/2008 | Hashiguchi et al. | 439/495 |
| 7,833,046 | B2 * | 11/2010 | Tamura et al. | 439/422 |

FOREIGN PATENT DOCUMENTS

| | | | |
|---|---|---|---|
| JP | 4425987 | B1 | 3/2010 |
| KR | 2002-0009473 | A | 2/2002 |
| KR | 10-0838786 | B1 | 6/2008 |
| KR | 2009-0030799 | A | 3/2009 |

OTHER PUBLICATIONS

English abstract of KR20090030799 published on Mar. 25, 2009, 1 page.
English abstract of KR20020009473 published on Feb. 1, 2002, 1 page.
English abstract of KR10-0838786 published on Jun. 19, 2008, 1 page.

* cited by examiner

CONNECTOR HAVING AN OPERATION LEVER AND ELASTIC NAILS

BACKGROUND OF THE INVENTION

1. Technical Field

The present invention relates to a connector, particularly to a connector having a structure capable of temporarily holding a flexible print substrate to be electrically connected.

2. Related Art

Conventionally, as a connector, for example Japanese Unexamined Patent Publication No. 2008-277068 discloses a cable connector (1) having (a) a housing (11) including an insertion hole (13) into which a plate shape cable (101) is inserted, an upper part (15) defining an upper side of the insertion hole (13), and side parts (16) defining both sides of the insertion hole (13); (b) terminals (51, 61) loaded in the housing (11) and electrically connected to a conductive line (151) of the plate shape cable (101), and an engagement member (81); (c) the plate shape cable (101) including a locking projection (113); (d) the engagement member (81) including a locking protrusion (83*a*) to be engaged with the locking projection (113); wherein (e) at least part of an upper end surface (83*c*) of the engagement member (81) protrudes to an upper side of an upper surface (15*a*) of the upper part (15) when the locking protrusion (83*a*) is in contact with an upper surface of the locking projection (113), and is placed on an equal level or below the upper surface (15*a*) of the upper part (15) when the locking protrusion (83*a*) is engaged with the locking projection (113).

SUMMARY

However, in the above cable connector, as clear from FIGS. 8 to 12 thereof, an inner beam portion 83 moving upward and downward is locked on a locking recess 112 of the plate shape cable 101 from an upper side so as to temporarily hold the plate shape cable. Therefore, it is not possible to confirm whether or not a distal end of the plate shape cable 101 is precisely placed at a predetermined position in the cable connector 1 from the outside, and thus inconvenience and erroneous connection may occur.

One or more embodiments of the present invention provides a connector capable of precisely and easily confirming whether or not a flexible print substrate to be electrically connected is placed at a predetermined position.

A connector according to one or more embodiments of the present invention includes a base having an opening formed on a front surface side into which a distal end of a flexible print substrate is insertable, and a plurality of insertion holes arranged side by side at a predetermined pitch passing through from the front surface side to a rear surface side, connection terminals respectively including substantially T shape operation pieces respectively having movable contacts formed at first ends in a protruding manner to be pressure-welded to connection portions arranged side by side in the distal end of the flexible print substrate, the connection terminals being adapted to be inserted into the insertion holes, and an operation lever supported on the rear surface side of the base turnably on a turning support point on an upper surface side of the connection terminals, the operation lever having cam portions capable of operating operation receiving portions placed at second ends of the operation pieces, the connector being adapted to temporarily hold the distal end of the flexible print substrate inserted from the opening of the base, and then hold the flexible print substrate by turning the operation lever and operating the connection terminals thereby pressure-welding the movable contacts of the connection terminals to the connection portions of the flexible print substrate, in which a pair of elastic nails to be elastically engaged from sides with cutouts provided in both side edges of the distal end of the flexible print substrate inserted from the opening of the base for temporarily holding the flexible print substrate is formed in a protruding manner inside the opening in the base, and inspection holes for visually checking outer circumferential edges of the elastic nails are formed on a top surface of the base.

According to one or more embodiments of the present invention, the outer circumferential edges of the elastic nails elastically deformable sideward can be visually checked from the inspection holes. Therefore, by visually checking the elastic nails from the inspection holes, it is possible to easily and precisely confirm a positioning work on whether or not the elastic nails are engaged with the cutouts of the flexible print substrate so as to precisely and temporarily hold the flexible print substrate.

According to one or more embodiments of the present invention, axes of the elastic nails may be flush with an axis of the flexible print substrate.

Accordingly, distortion or the like is not generated in the elastic nails, and the elastic nails precisely and temporarily hold the flexible print substrate. Therefore, it is possible to obtain the connector with higher positioning accuracy.

According to one or more embodiments of the present invention, substantially U shape clearances in a plan view may be formed between opening edges of the inspection holes and the outer circumferential edges of the elastic nails except base parts.

Accordingly, by confirming whether or not there are the substantially U shape clearances in a plan view, it is possible to easily determine whether or not the flexible print substrate is precisely and temporarily held by the connector. Therefore, workability and reliability are improved.

According to one or more embodiments of the present invention, the elastic nails may be formed in a sideward protruding manner on side surfaces of a support wall integrally formed so that the top surface is continuous to a bottom surface of the base.

Accordingly, the support wall supporting the elastic nails is integrally formed so that the top surface is continuous to the bottom surface of the base. Therefore, support strength of the elastic nails is enhanced, and the connector having high durability can be obtained.

According to one or more embodiments of the present invention, ribs not in contact with the elastic nails may be formed in a sideward protruding manner at least in outer parts of opposed side edges forming the opening edges of the inspection holes.

Accordingly, since the ribs can be extended to the vicinity of the outer circumferential edges of the elastic nails, a reinforcing effect can be obtained. Further, since the clearances formed between the opening edges of the inspection holes and the outer circumferential edges of the elastic nails can be reduced, intrusion of dust and the like can be prevented.

According to one or more embodiments of the present invention, step portions may be formed in areas on a lower side of the inspection holes.

Accordingly, even when the dust and the like intrude the inside from the inspection holes, the dust and the like can be discharged from clearances formed by the step portions to the outside. Therefore, contact reliability is improved.

A manufacturing method for a connector according to one or more embodiments of the present invention includes the step of making the inspection holes and the elastic nails forming the above base with upper and lower molds.

According to one or more embodiments of the present invention, since the inspection holes and the elastic nails can be formed by the upper and lower molds, manufacturing cost can be reduced. Further, since the number of manufacturing process is small, there is an effect that the manufacturing method for the connector with high productivity can be obtained.

DETAILED DESCRIPTION

Figure 1A:
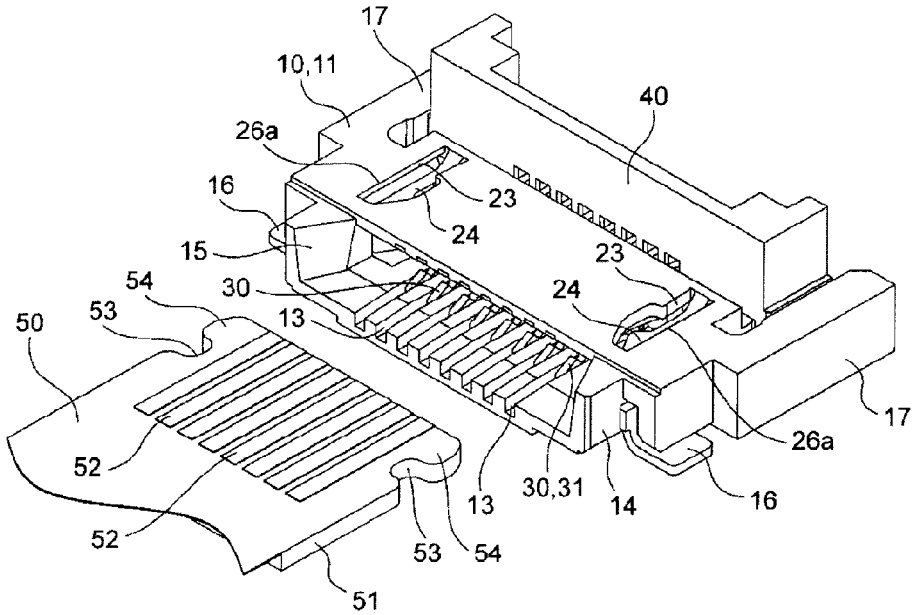
FIGS. 1A and 1B are perspective views showing a connector according to a first embodiment of the present invention before and after operation.

Embodiments of a connector according to the present invention will be described with reference to FIGS. 1 to 12. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

As shown in FIGS. 1 to 11, a connector 10 according to a first embodiment broadly includes a base 11, connection terminals 30, and an operation lever 40. The connector 10 is for electrically connecting a flexible print substrate 50 to another print substrate 55 (refer to FIG. 8).

Figure 3:
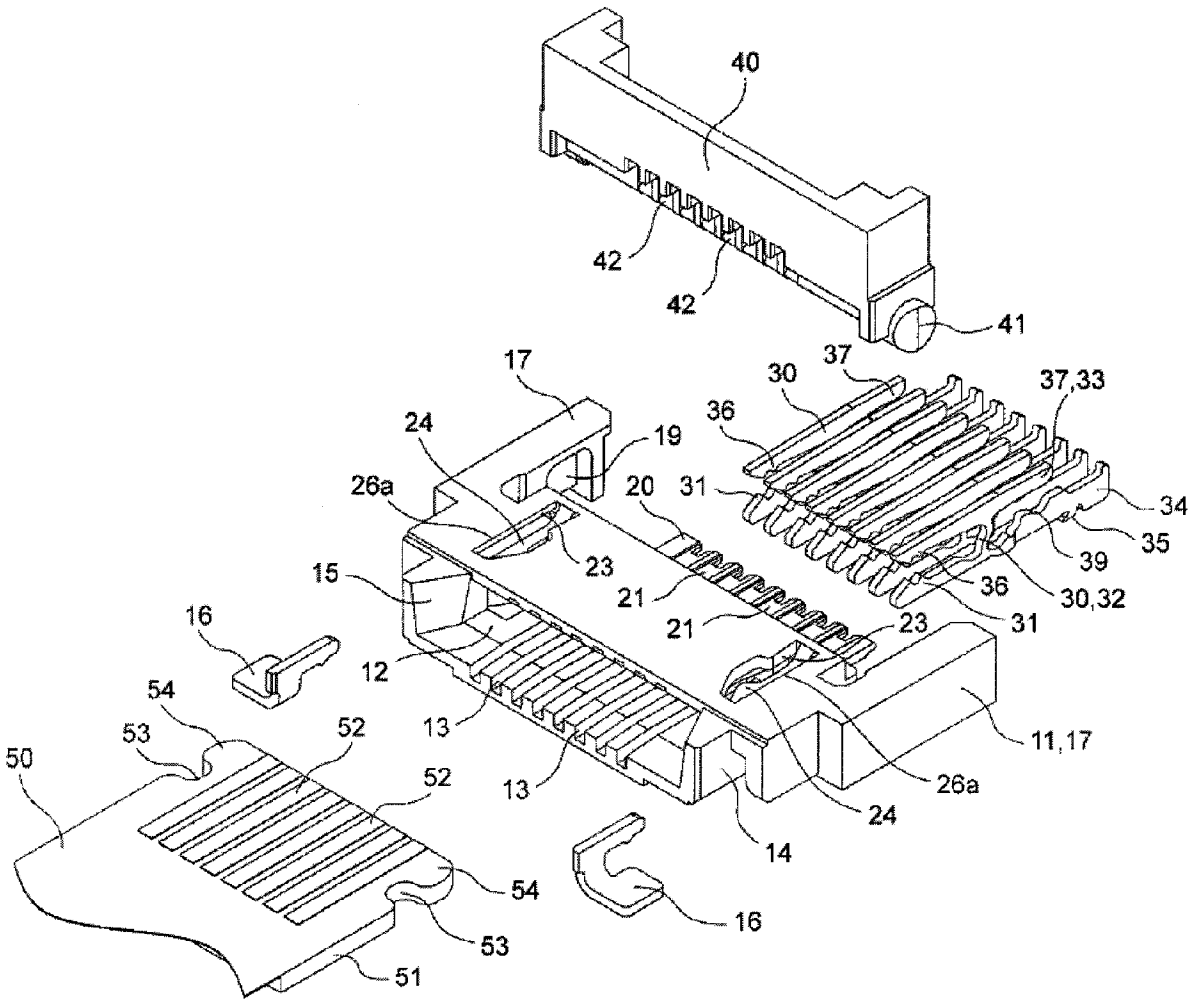
FIG. 3 is an exploded perspective view of the connector shown in FIG. 1.
Figure 4:
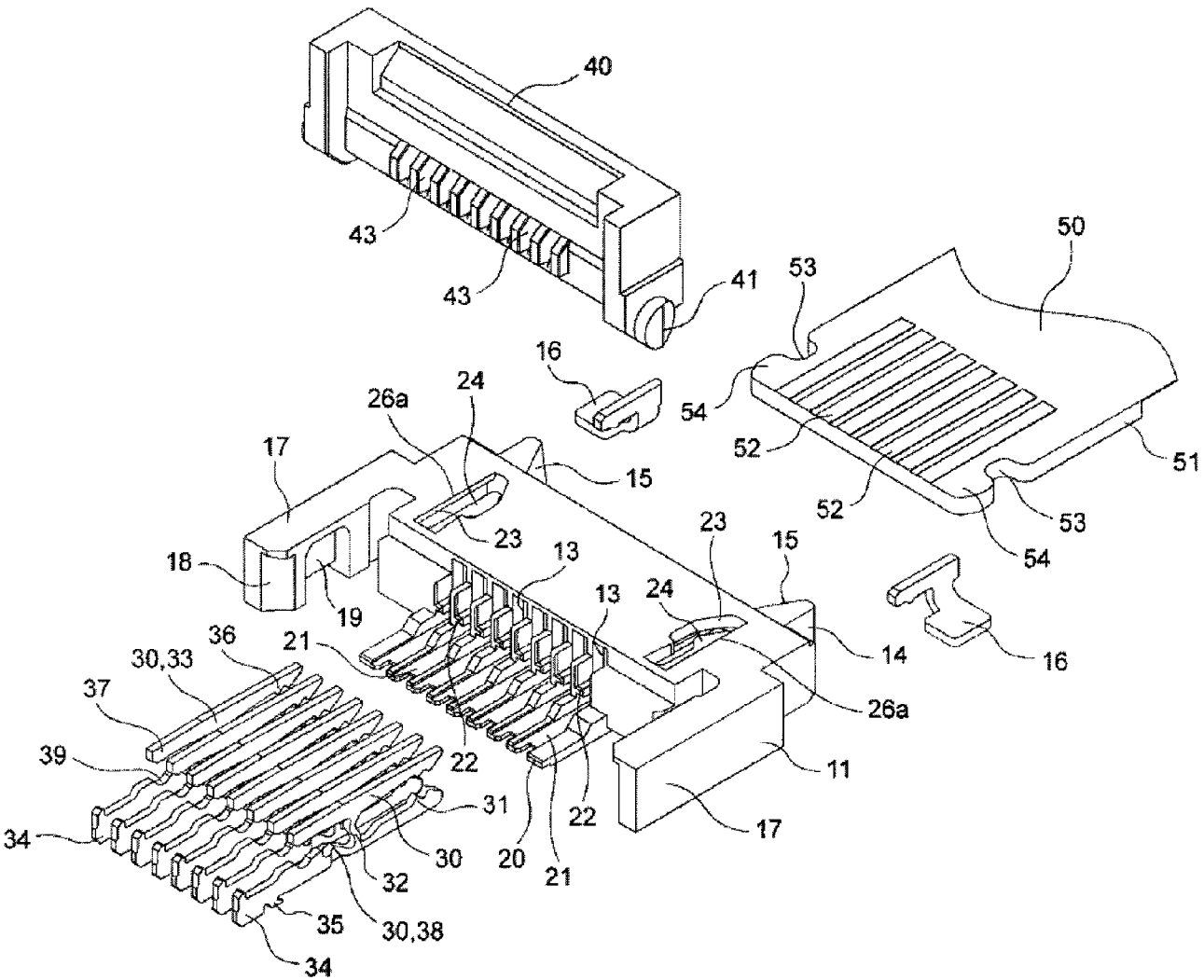
FIG. 4 is an exploded perspective view of the connector shown in FIG. 2.

As shown in FIGS. 3 and 4, the base 11 has a plurality of insertion holes 13 arranged side by side at a predetermined pitch passing through from an opening 12 on a front surface side to a rear surface side. A guide receiving portion 14 with a substantially C shape section for guiding the flexible print substrate 50 inserted from the opening 12 is formed in a protruding manner on the front surface side. The guide receiving portion 14 has tapered surfaces 15 respectively formed on opposed opening inner edges thereof. Fixing fittings 16 with substantially L shape sections are press-fitted and fixed to the outside of the guide receiving portion 14 for preventing uplift of the base 11.

As shown in FIG. 4, the base 11 has elastic arms 17 extending in parallel on the rear surface side from edges of both side end surfaces thereof. In inward surfaces of the elastic arms 17, guide tapered surfaces 18 are respectively formed at distal end edges on the inner side and bearing recesses 19 are respectively formed on the far side. Further, the base 11 has a guide plate 20 extending in parallel between the edge on a lower side of the rear surface and the elastic arms 17. Guide grooves 21 communicating with the insertion holes 13 are formed in the guide plate 20. Press-fitting ribs 22 are formed in a sideward protruding manner along the guide grooves 21 so as to be placed on the obliquely upper side of the guide grooves 21.

Figure 8B:
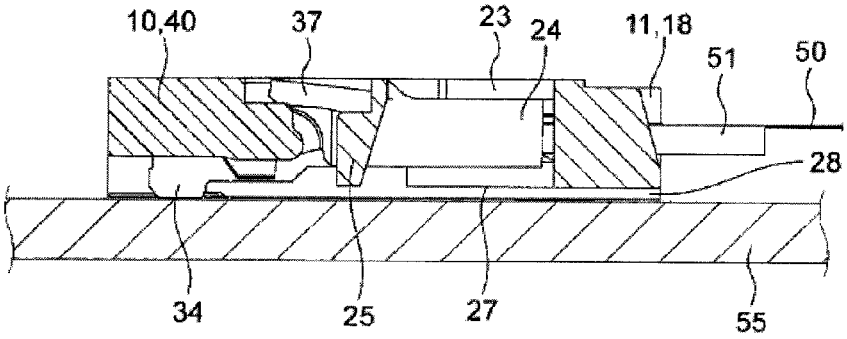
Figure 8C:
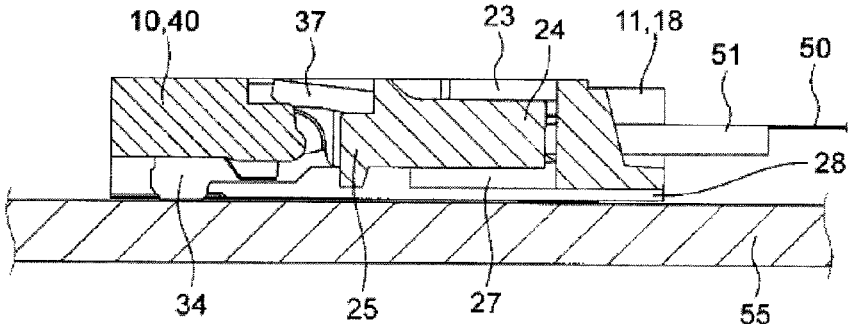
Figure 9A:
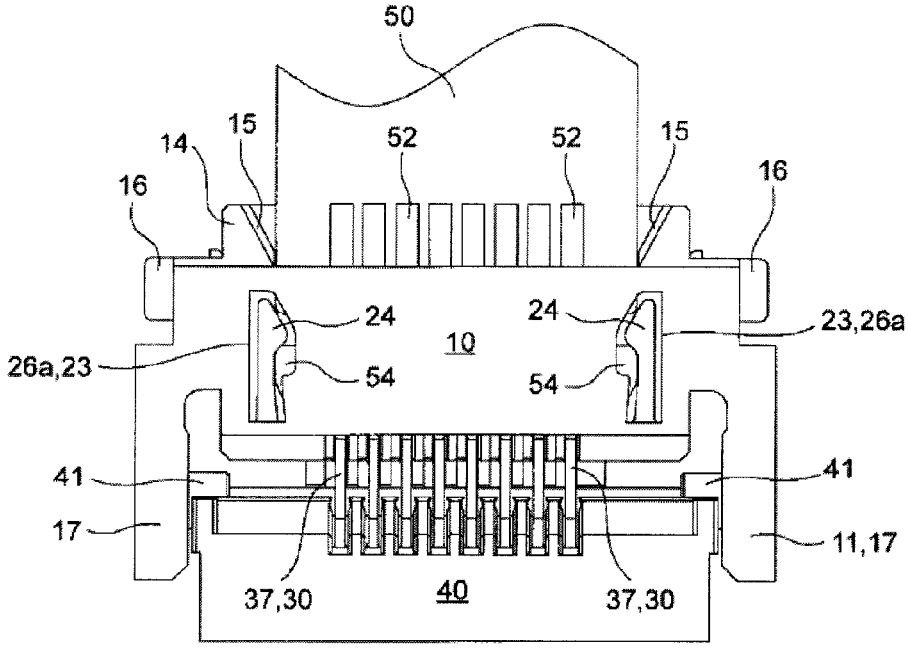
FIGS. 9A and 9B are a plan view and a plan sectional view, respectively, showing a state that the flexible print substrate is connected to the connector of FIG. 1.
Figure 9B:
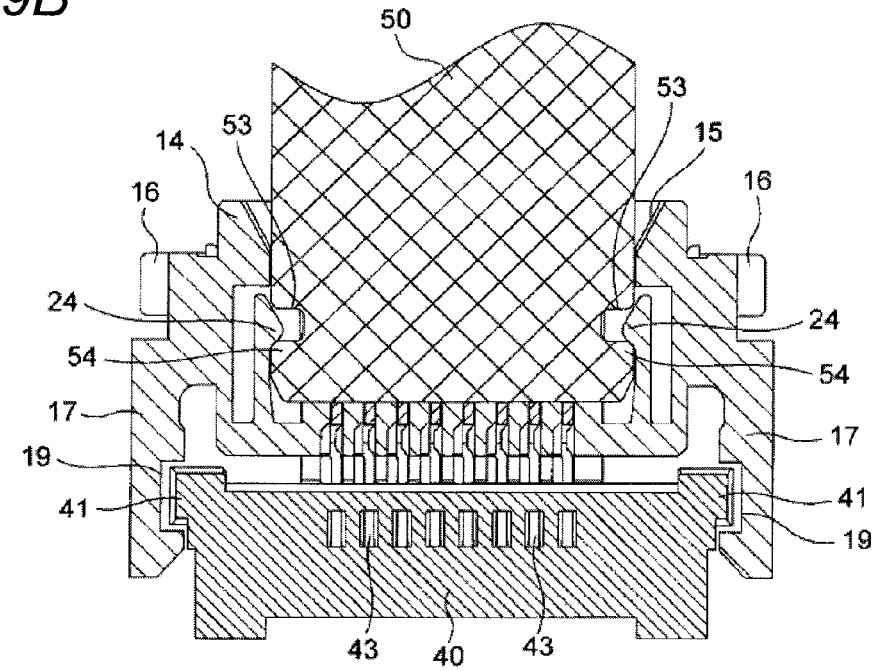

Further, the base 11 has inspection holes 23 respectively formed in the vicinity of both ends of a flat surface thereof for visually checking elastic nails 24. For example, as shown in FIG. 9, the inspection holes 23 are shaped so that outer circumferential edges of the elastic nails 24 except base parts of the elastic nails 24 can be visually checked and locking corner portions 54 of the flexible print substrate 50 described later can be also visually checked. Particularly, since substantially U shape clearances are formed between the inspection holes 23 and the elastic nails 24, it is possible to precisely recognize positions of the elastic nails 24 and thus a position of the flexible print substrate 50 based on shapes of the clearances. As shown in FIGS. 8B and 8C, the base parts of the elastic nails 24 extend from side surfaces of a support wall 25 formed so that a top surface of the base 11 is continuous to a bottom surface to the front surface side. Therefore, it is possible to obtain the elastic nails 24 having high support strength.

Figure 8A:
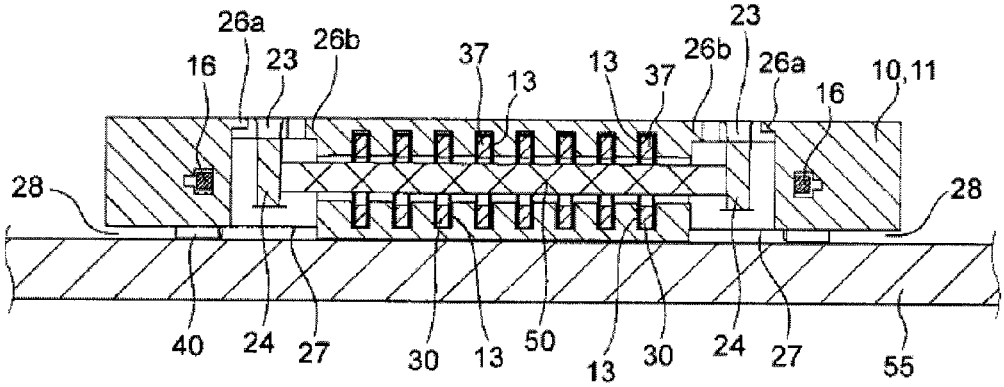
FIGS. 8A, 8B and 8C are sectional views showing a state that the flexible print substrate is connected to the connector of FIG. 1 mounted on a surface of a print substrate.

As shown in FIG. 8A, the base 11 has ribs 26*a* and 26*b* extending inward from the opposed side edges of peripheral edges of the inspection holes 23 provided on the top surface. Particularly, the rib 26*a* placed on the outer side can prevent intrusion of dust and the like and has a position and a shape so as not to be in contact with the elastic nails even when the elastic nails 24 are elastically deformed outward.

Further, shallow step portions 27 are formed in areas on a lower side of the elastic nails 24 on the bottom surface of the base 11. Therefore, clearances 28 are formed between a surface of the print substrate 55 on which the base 11 of the connector 10 according to one or more embodiments of the present invention is mounted and bottom surfaces of the step portions 27 of the base 11. As a result, for example, there is an advantage that the dust and the like can be discharged from the clearances 28 to the outside even when the dust and the like intrude the inside from the inspection holes 23.

Figure 5A:
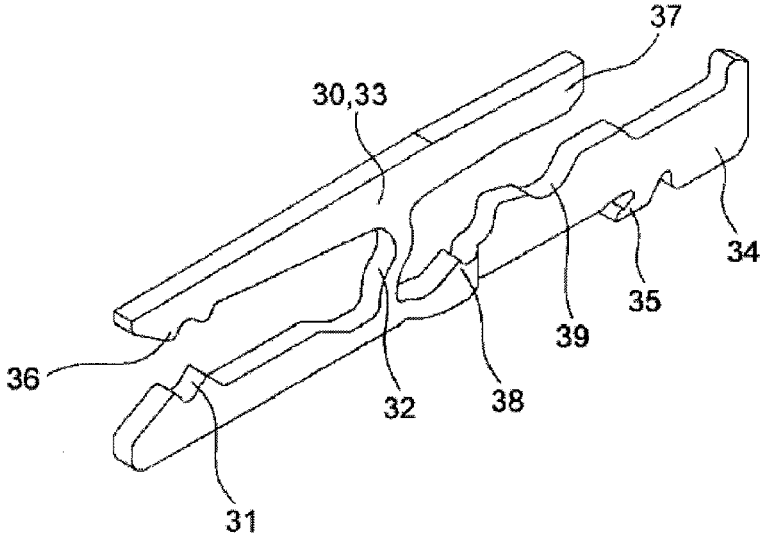
FIGS. 5A and 5B are perspective views of a connection terminal shown in FIGS. 3 and 4.
Figure 5B:
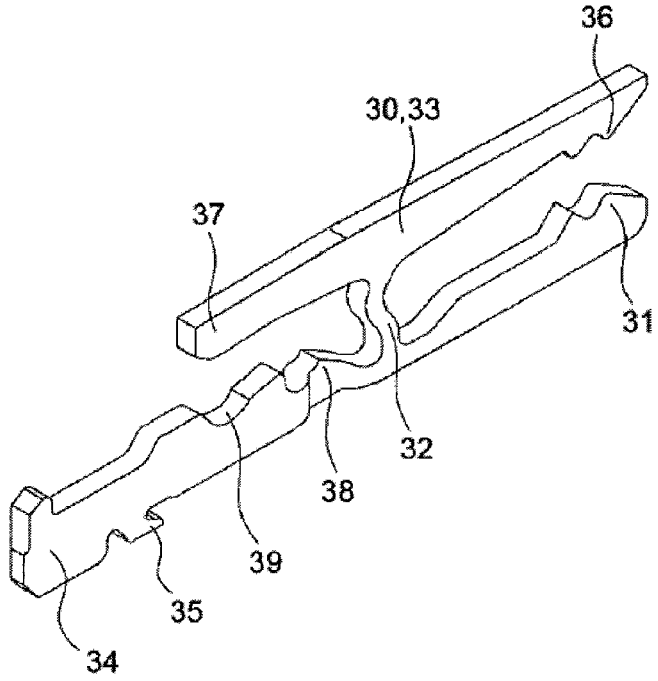

As shown in FIG. 5, each of the connection terminals 30 has a first end (one distal end) 31 provided with an engagement protrusion being insertable from the guide groove 21 of the base 11 into the insertion hole 13, a substantially T shape operation piece 33 having a support portion 32 formed in a protruding manner from an intermediate portion thereof, and a locking nail 35 provided in a lower edge of a second end (the other distal end) 34. A movable contact 36 protrudes downward from a first end of the operation piece 33, and a second end thereof serves as an operation receiving portion 37. Further, the connection terminal 30 has a slip-out nail 38 protruding in the plate thickness direction from a base part of the support portion 32. A turning receiving portion 39 is formed between the second end 34 and the slip-out nail 38.

When the connection terminals 30 are slid and moved along the guide grooves 21 of the base 11 and inserted into the insertion holes 13, the slip-out nails 38 are locked on the press-fitting ribs 22. Further, when the connection terminals 30 are press-fitted, the locking nails 35 are locked on a lower edge of the base 11 and placed at predetermined positions.

As shown in FIGS. 3 and 4, the operation lever 40 has turning shaft portions 41, 41 formed in a protruding manner on the same axis on both side end surfaces. The operation lever 40 has cam portions 42 (refer to FIG. 7) arranged side by side at a predetermined pitch on an edge on one side for operating the operation receiving portions 37 of the connection terminals 30, and through holes 43 arranged side by side at positions corresponding to the cam portions 42 into which the operation receiving portions 37 are insertable are arranged.

The operation receiving portions 37 of the connection terminals 30 are inserted into the through holes 43 of the operation lever 40, the operation lever 40 is slid along upper surfaces of the connection terminals 30, and the operation receiving portions 37 are pushed up and pushed in while being elastically deformed with the cam portions 42. Thereby, the cam portions 42 are fitted to the turning receiving portions 39 of the connection terminals 30, and the turning shaft portions 41 are fitted to the bearing recesses 19 of the base 11. Thus, the operation lever 40 is turnably supported.

Figure 1B:
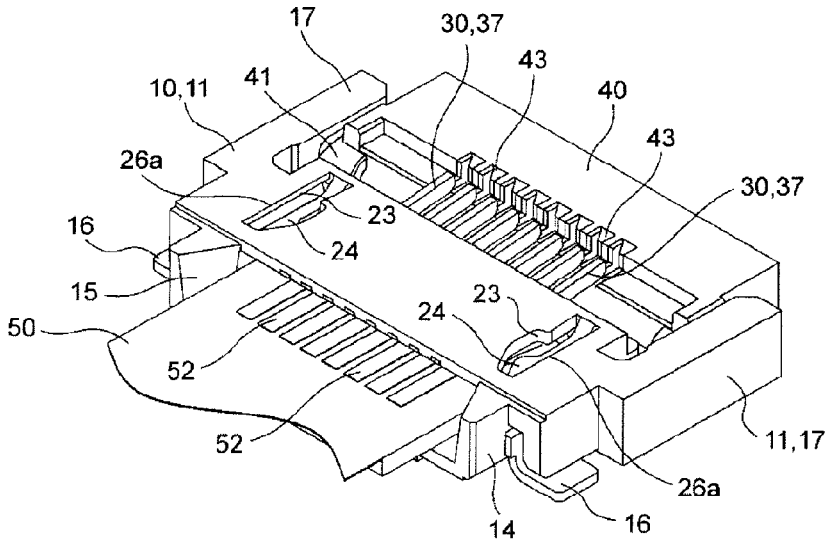
Figure 2A:
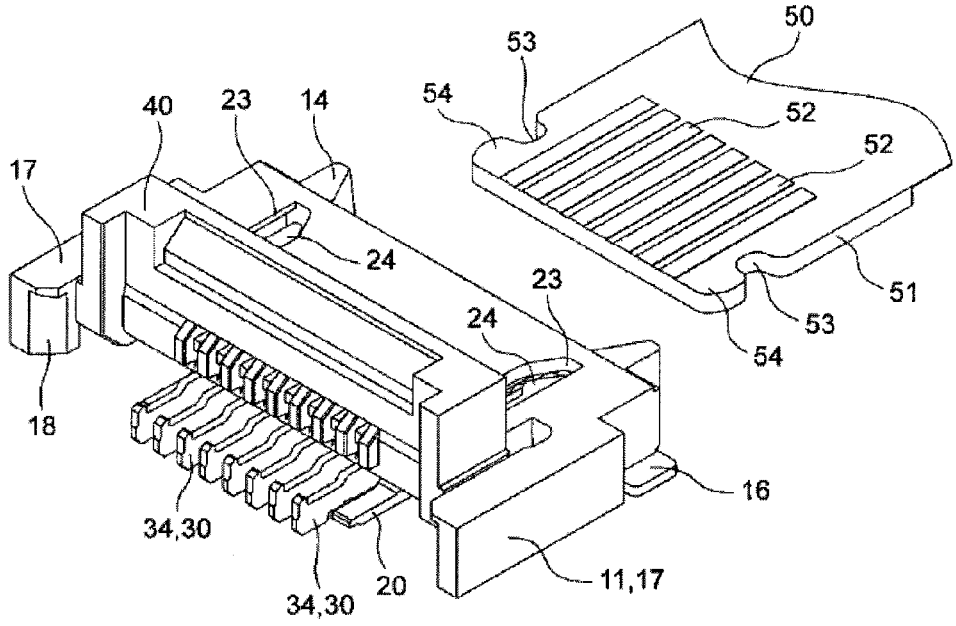
FIGS. 2A and 2B are perspective view showing the connector shown in FIG. 1 before and after the operation seen from different angles.
Figure 2B:
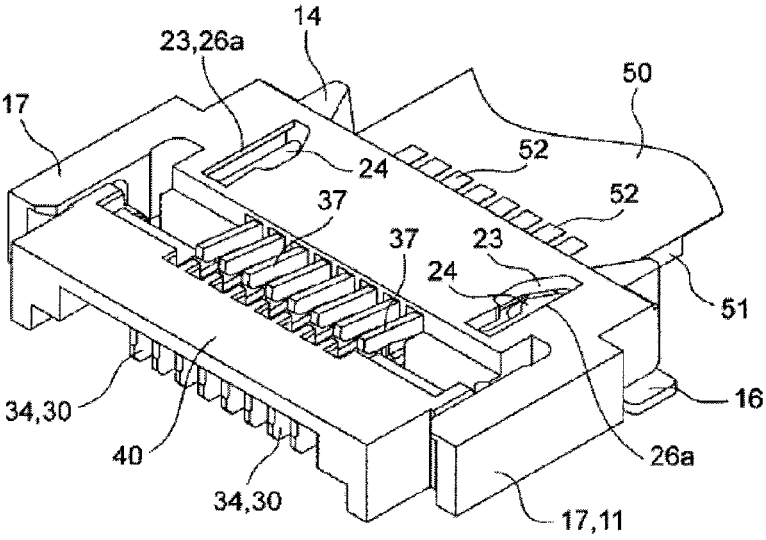

As shown in FIGS. 1 and 2, the flexible print substrate 50 to be electrically connected has a plurality of connection portions 52 arranged side by side on a surface of a distal end lined with a reinforcing plate 51. Engagement cutouts 53 are provided on both side edges of the distal end so as to bring out locking corner portions 54.

Figure 6A:
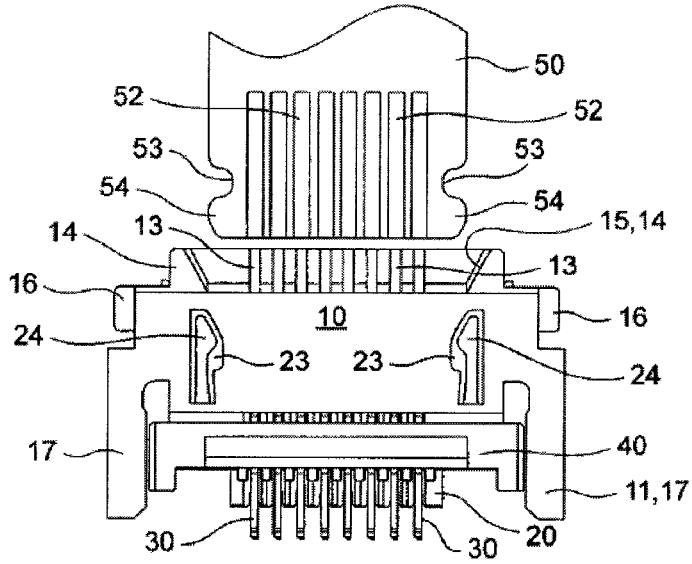
FIGS. 6A, 6B and 6C are plan views showing steps of connecting a flexible print substrate to the connector of FIG. 1.
Figure 6B:
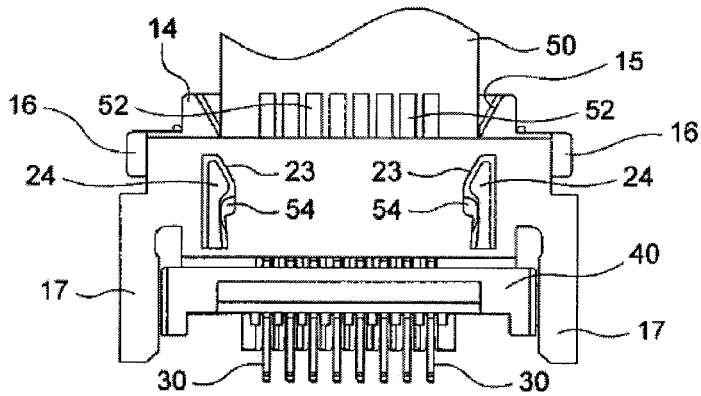
Figure 6C:
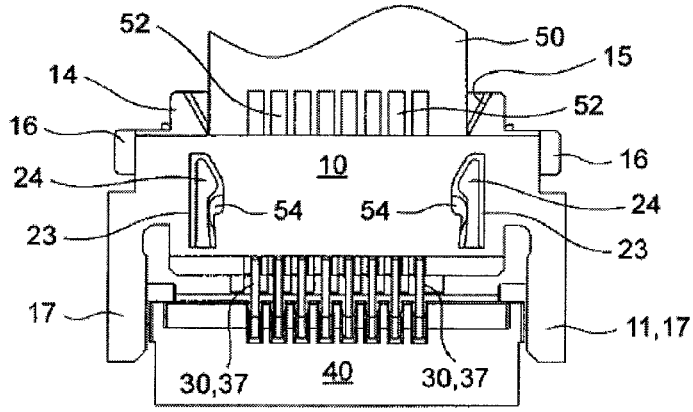

Next, a method of connecting and fixing the flexible print substrate 50 to the connector 10 mounted on the surface of the print substrate 55 will be described (refer to FIGS. 6 and 7).

Firstly, the distal end of the flexible print substrate 50 is inserted from the opening 12 on the front surface side of the base 11, and the elastic nails 24 are elastically deformed outward and engaged with the engagement cutouts 53 so as to temporarily hold the flexible print substrate 50. At this time, in a case where the distal end is precisely inserted into a predetermined position, not only the locking corner portions 54 of the flexible print substrate 50 but also the clearances formed by the outer circumferential edges of the elastic nails 24 except the base parts and the inspection holes 23 can be visually checked from the inspection holes 23 as shown in FIG. 9. Thus, it is possible to confirm precise positioning.

Figure 7A:
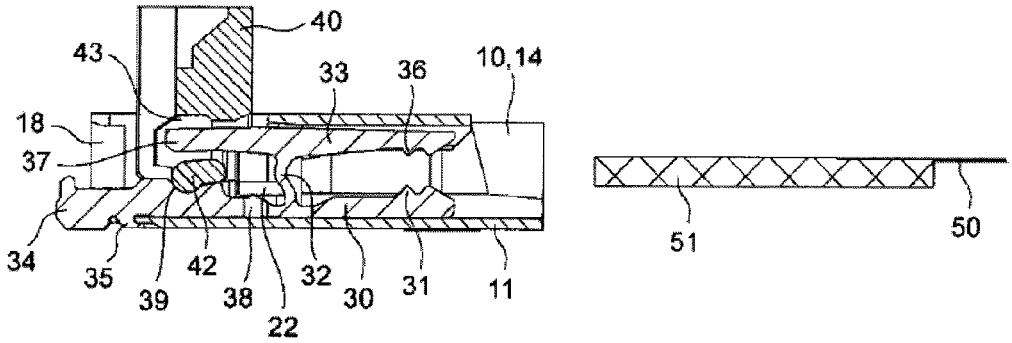
FIGS. 7A, 7B and 7C are sectional views showing the steps of connecting the flexible print substrate to the connector of FIG. 1.
Figure 7B:
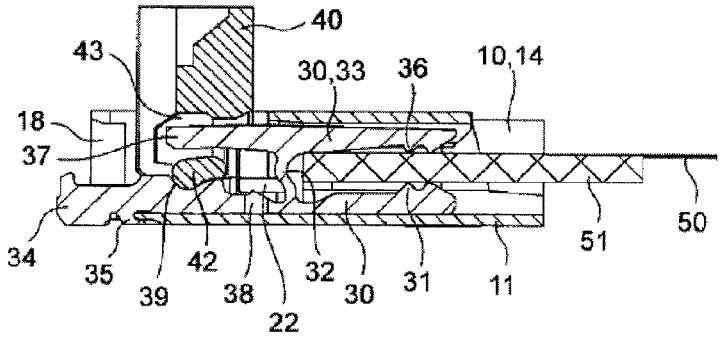
Figure 7C:
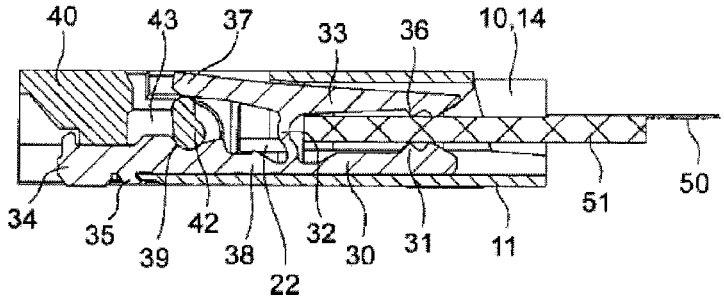

When the operation lever 40 is turned and pushed down relative to the axis of the turning shaft portions 41, the cam portions 42 simultaneously push up the operation receiving portions 37 of the connection terminals 30 as shown in FIG. 7. Therefore, the substantially T shape operation pieces 33 tilt with the support portions 32 as support points, the distal end of the flexible print substrate 50 is nipped by the movable contacts 36 and the first ends 31, and the movable contacts 36 pressure-welded and conducted to the connection portions 52.

Figure 10A:
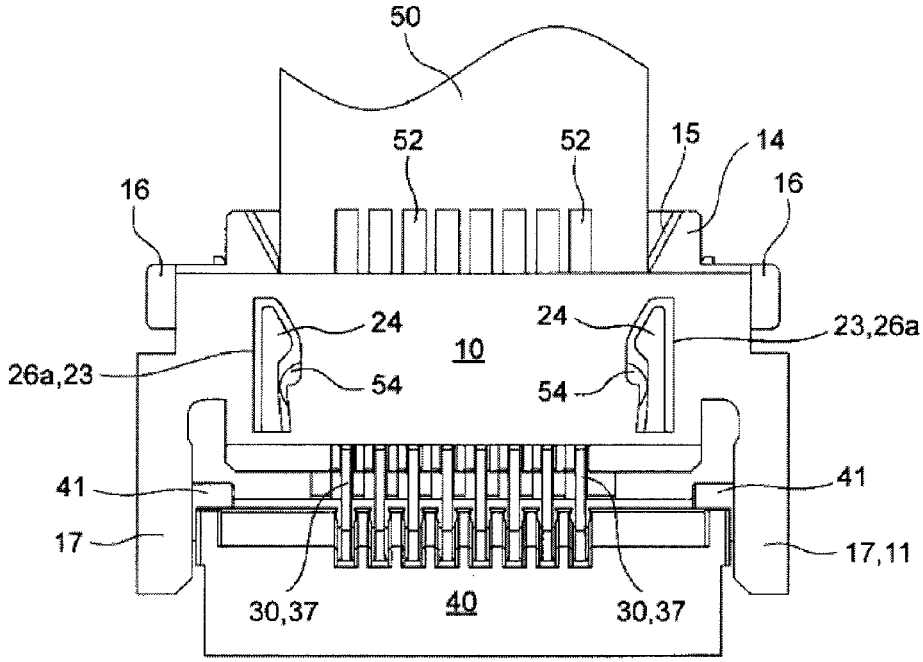
FIGS. 10A and 10B are a plan view and a plan sectional view, respectively, showing a state that a different flexible print substrate is connected to the connector of FIG. 1.
Figure 10B:
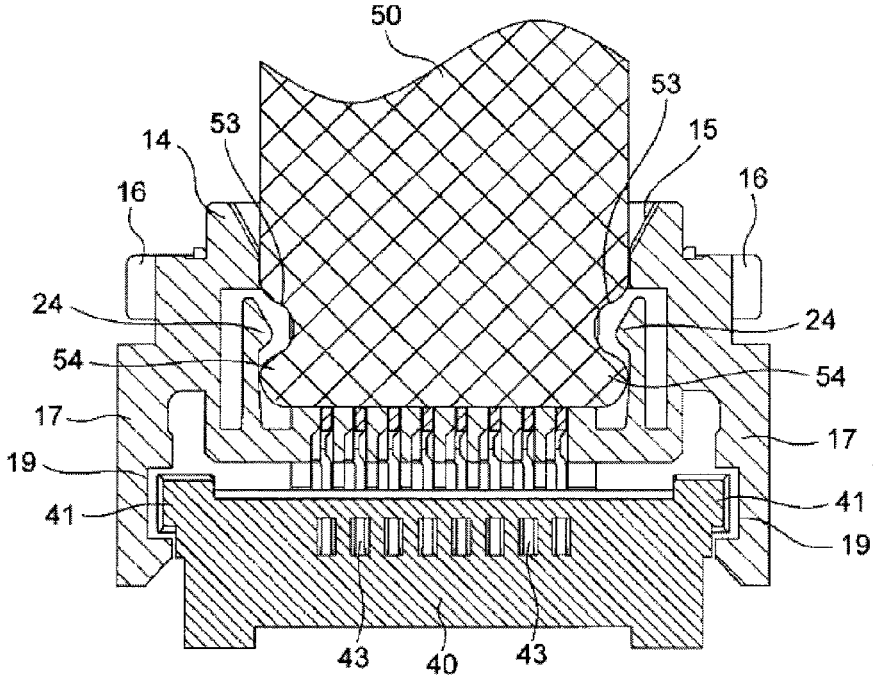

Even when size of the engagement cutouts 53 of the flexible print substrate 50 varies, for example when the engagement cutouts 53 are excessively large as shown in FIG. 10, with engagement cutouts 53 being precisely placed at a predetermined position, it is possible to easily and precisely perform determination based on the shapes of the clearances formed by the inspection holes 23 and the elastic nails 24.

Particularly, when the light is shed from a lower side of the print substrate 55, there is an advantage that a positioning state of the flexible print substrate 50 can be more clearly determined by distinguishing the shapes of the clearances through which the light passes.

Figure 11A:
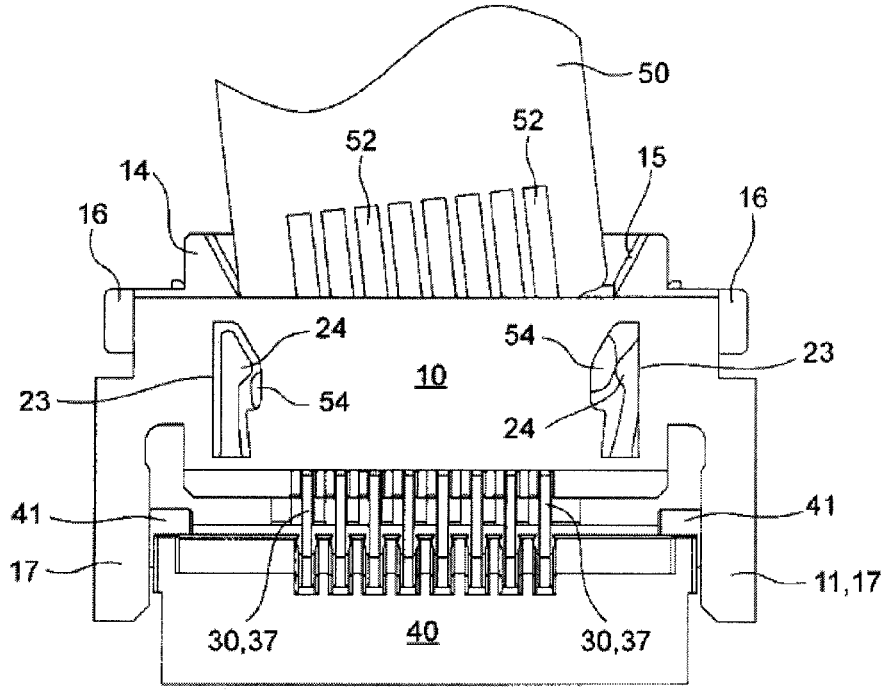
FIGS. 11A and 11B are a plan view and a plan sectional view, respectively, showing a state that the flexible print substrate is imprecisely connected to the connector of FIG. 1.
Figure 11B:
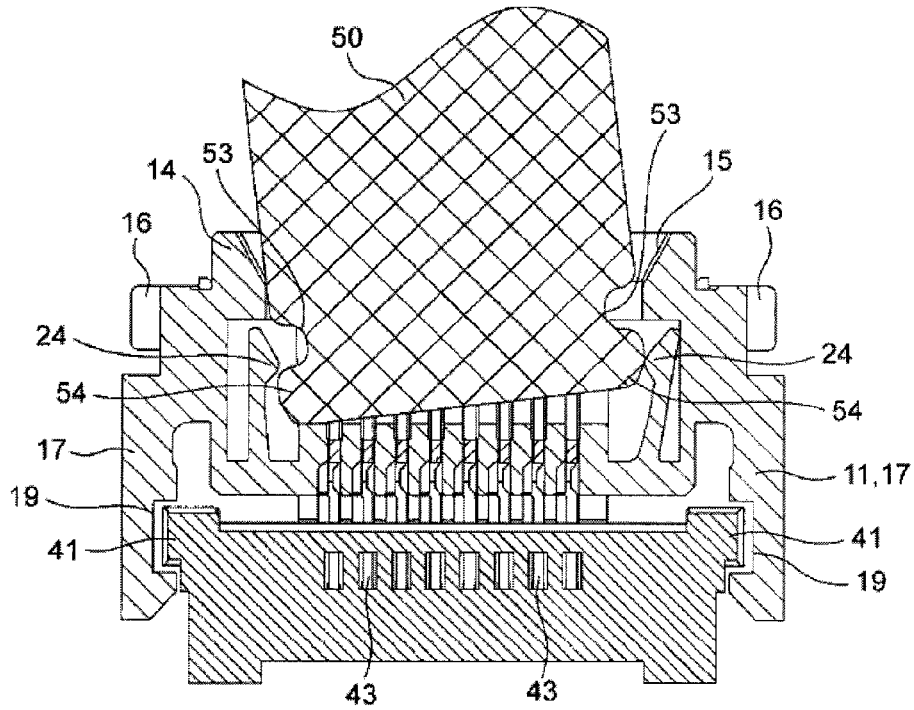

Even when the flexible print substrate 50 is imprecisely inserted, the locking corner portions 54 of the flexible print substrate 50 are partially in contact with the elastic nails 24 as shown in FIG. 11, and the substantially U shape clearances formed by the outer circumferential edges of the elastic nails 24 and the opening edges of the inspection holes 23 cannot be visually checked. Thus, precision or imprecision positioning can be recognized at a glance.

Figure 12:
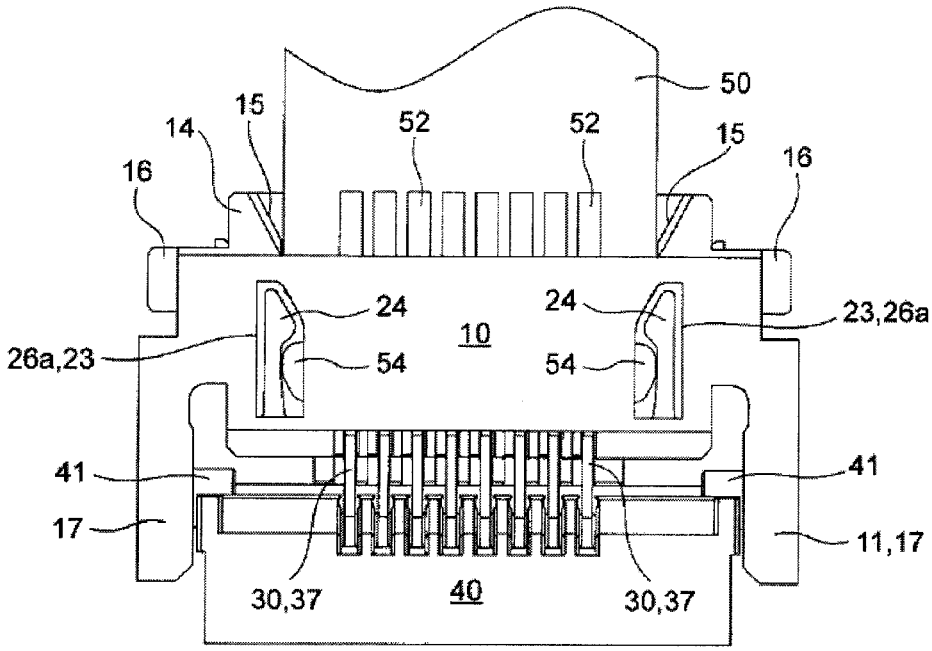
FIG. 12 is a plan view showing a state that the flexible print substrate is connected to a connector according to a second embodiment of the present invention.

It should be noted that the inspection holes 23 are not limited to the above shapes but may have substantially uniform dimension overall as in a second embodiment shown in FIG. 12.

According to one or more embodiments of the present invention, there is an advantage that the locking corner portions 54 of the flexible print substrate 50 can be clearly visually checked so that a confirmation work is more easily performed.

The connector according to one or more embodiments of the present invention is not limited to the above connector but, as a matter of course, may be applied to other connectors.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector, comprising:

a base having:

an opening formed on a front surface side into which a distal end of a flexible print substrate is insertable; and a plurality of insertion holes arranged side by side at a predetermined pitch passing through from the front surface side to a rear surface side;

connection terminals respectively including substantially T shape operation pieces respectively having movable contacts formed at first ends in a protruding manner to be pressure-welded to connection portions arranged side by side in the distal end of the flexible print substrate, the connection terminals being adapted to be inserted into the insertion holes; and an operation lever supported on the rear surface side of the base turnably on a turning support point on an upper surface side of the connection terminals, the operation lever having cam portions capable of operating operation receiving portions placed at second ends of the operation pieces, the connector being adapted to temporarily hold the distal end of the flexible print substrate inserted from the opening of the base, and then hold the flexible print substrate by turning the operation lever and operating the connection terminals thereby pressure-welding the movable contacts of the connection terminals to the connection portions of the flexible print substrate, wherein a pair of elastic nails to be elastically engaged from sides with cutouts provided in both side edges of the distal end of the flexible print substrate inserted from the opening of the base for temporarily holding the flexible print substrate is formed in a protruding manner inside the opening in the base, and inspection holes for visually checking outer circumferential edges of the elastic nails are formed on a top surface of the base, and wherein axes of the elastic nails are flush with an axis of the flexible print substrate.

2. The connector according to claim 1, wherein step portions are formed in areas on a lower side of the inspection holes.

3. A manufacturing method for a connector, comprising a step of making the inspection holes and the elastic nails forming the base according to claim 1 with upper and lower molds.

4. The connector according to claim 1, wherein substantially U shape clearances in a plan view are formed between opening edges of the inspection holes and the outer circumferential edges of the elastic nails except base parts.

5. The connector according to claim 1, wherein the elastic nails are formed in a sideward protruding manner on side surfaces of a support wall integrally formed so that the top surface is continuous to a bottom surface of the base.

6. The connector according claim 1, wherein ribs not in contact with the elastic nails are formed in a sideward protruding manner at least in outer parts of opposed side edges forming the opening edges of the inspection holes.

7. The connector according to claim 1, wherein step portions are formed in areas on a lower side of the inspection holes.

8. The connector according to claim 1, wherein substantially U shape clearances in a plan view are formed between opening edges of the inspection holes and the outer circumferential edges of the elastic nails except base parts.

9. The connector according to claim 8, wherein the elastic nails are formed in a sideward protruding manner on side surfaces of a support wall integrally formed so that the top surface is continuous to a bottom surface of the base.

10. The connector according claim 8, wherein ribs not in contact with the elastic nails are formed in a sideward protruding manner at least in outer parts of opposed side edges forming the opening edges of the inspection holes.

11. The connector according to claim 8, wherein step portions are formed in areas on a lower side of the inspection holes.

12. The connector according claim 1, wherein ribs not in contact with the elastic nails are formed in a sideward protruding manner at least in outer parts of opposed side edges forming the opening edges of the inspection holes.

13. The connector according to claim 12, wherein step portions are formed in areas on a lower side of the inspection holes.

14. A connector, comprising:

a base having:

an opening formed on a front surface side into which a distal end of a flexible print substrate is insertable; and a plurality of insertion holes arranged side by side at a predetermined pitch passing through from the front surface side to a rear surface side;

connection terminals respectively including substantially T shape operation pieces respectively having movable contacts formed at first ends in a protruding manner to be pressure-welded to connection portions arranged side by side in the distal end of the flexible print substrate, the connection terminals being adapted to be inserted into the insertion holes; and an operation lever supported on the rear surface side of the base turnably on a turning support point on an upper surface side of the connection terminals, the operation lever having cam portions capable of operating operation receiving portions placed at second ends of the operation pieces, the connector being adapted to temporarily hold the distal end of the flexible print substrate inserted from the opening of the base, and then hold the flexible print substrate by turning the operation lever and operating the connection terminals thereby pressure-welding the movable contacts of the connection terminals to the connection portions of the flexible print substrate, wherein a pair of elastic nails to be elastically engaged from sides with cutouts provided in both side edges of the distal end of the flexible print substrate inserted from the opening of the base for temporarily holding the flexible print substrate is formed in a protruding manner inside the opening in the base, and inspection holes for visually checking outer circumferential edges of the elastic nails are formed on a top surface of the base, and wherein the elastic nails are formed in a sideward protruding manner on side surfaces of a support wall integrally formed so that the top surface is continuous to a bottom surface of the base.

15. The connector according claim 14, wherein ribs not in contact with the elastic nails are formed in a sideward protruding manner at least in outer parts of opposed side edges forming the opening edges of the inspection holes.

16. The connector according to claim 14, wherein step portions are formed in areas on a lower side of the inspection holes.

* * * * *